US009326613B2

(12) United States Patent
Cvek

(10) Patent No.: US 9,326,613 B2
(45) Date of Patent: May 3, 2016

(54) UPHOLSTERED SEAT WITH FLEXIBLE PELVIC SUPPORT

(71) Applicant: Sava Cvek, Jamaica Plain, MA (US)

(72) Inventor: Sava Cvek, Jamaica Plain, MA (US)

( * ) Notice: Subject to any disclaimer, the term of this patent is extended or adjusted under 35 U.S.C. 154(b) by 0 days.

(21) Appl. No.: 14/138,009

(22) Filed: Dec. 21, 2013

(65) Prior Publication Data

US 2014/0183924 A1 Jul. 3, 2014

Related U.S. Application Data

(60) Provisional application No. 61/747,588, filed on Dec. 31, 2012.

(51) Int. Cl.

| | |
|---|---|
| ***A47C 7/22*** | (2006.01) |
| ***A47C 7/02*** | (2006.01) |
| ***A47C 9/00*** | (2006.01) |

(52) U.S. Cl.

CPC . *A47C 7/022* (2013.01); *A47C 7/02* (2013.01); *A47C 9/002* (2013.01)

(58) Field of Classification Search

CPC ..... B60N 2/68; B60N 2/682
USPC ..... 297/452.15, 452.18, 452.23, 452.26, 297/452.27, 452.54

See application file for complete search history.

(56) References Cited

U.S. PATENT DOCUMENTS

| | | | | | |
|---|---|---|---|---|---|
| 3,178,221 | A | | 4/1965 | Schwarz | |
| 3,197,789 | A | | 8/1965 | Ashkouti et al. | |
| 3,258,259 | A | | 6/1966 | Bohlin | |
| 3,353,869 | A | * | 11/1967 | Getz et al. | 297/452.49 |
| 3,529,866 | A | * | 9/1970 | Getz | 297/452.53 |
| 3,614,159 | A | | 10/1971 | Christin | |
| 3,647,260 | A | | 3/1972 | Grant et al. | |
| 4,018,479 | A | | 4/1977 | Ball | |
| 4,465,317 | A | | 8/1984 | Schwarz | |
| 4,660,887 | A | * | 4/1987 | Fleming et al. | 297/448.2 |
| 4,712,834 | A | | 12/1987 | Warrick | |
| 4,810,033 | A | | 3/1989 | Kemmann | |
| 4,880,272 | A | | 11/1989 | Brauning | |
| 4,953,913 | A | * | 9/1990 | Graebe | 297/452.25 |
| 5,076,643 | A | | 12/1991 | Colasanti et al. | |
| 5,123,702 | A | * | 6/1992 | Caruso | 297/440.21 |
| 5,190,348 | A | | 3/1993 | Colasanti | |
| 5,338,091 | A | | 8/1994 | Miller | |
| 5,383,712 | A | | 1/1995 | Perry | |
| 5,513,899 | A | * | 5/1996 | Michaels et al. | 297/452.41 |
| 5,577,811 | A | * | 11/1996 | Ogg | 297/452.15 |
| 5,772,282 | A | | 6/1998 | Stumpf et al. | |

(Continued)

*Primary Examiner* — David R Dunn
*Assistant Examiner* — Jody Giacoman
(74) *Attorney, Agent, or Firm* — Thomas P. O'Connell; O'Connell Law Firm

(57) ABSTRACT

An upholstered seat with flexible pelvic support having a seat bottom with a seat pan, upholstery, and resiliently deflectable pelvic support structures retained at least partially within the central area of the seat pan. Plural resiliently deflectable fingers can project to within a left portion of the central area and plural resiliently deflectable fingers can project to within a right portion of the central area. The resiliently deflectable fingers can have different deflection resistances to permit hyper-localized control over the resilient support provided. A U-shaped rigidifying member secured to the seat pan establishes rigidified lateral and posterior portions of the seat pan. A resiliently compressible foam structure can have a U-shaped outer portion and a softer inner portion to facilitate a cradling of a seat occupant. A support and positioning member can be retained by a seat back in a fixed angular orientation relative to the seat bottom.

15 Claims, 9 Drawing Sheets

(56) References Cited

U.S. PATENT DOCUMENTS

| | | | | |
|---|---|---|---|---|
| 5,868,466 | A | 2/1999 | Massara et al. | |
| 6,158,815 | A * | 12/2000 | Sugie | A47C 7/282 297/452.49 |
| D449,174 | S * | 10/2001 | Neil | D6/366 |
| 6,354,662 | B1 | 3/2002 | Su | |
| 6,386,634 | B1 | 5/2002 | Stumpf et al. | |
| 6,394,546 | B1 | 5/2002 | Knoblock et al. | |
| 6,575,530 | B1 | 6/2003 | Fischer et al. | |
| 6,588,842 | B2 | 7/2003 | Stumpf et al. | |
| 6,669,301 | B1 * | 12/2003 | Funk et al. | 297/452.63 |
| 6,942,300 | B2 | 9/2005 | Numa et al. | |
| 6,966,604 | B2 | 11/2005 | Stumpf et al. | |
| 6,983,997 | B2 | 1/2006 | Wilkerson et al. | |
| 7,066,537 | B2 | 6/2006 | Coffield et al. | |
| 7,249,802 | B2 | 7/2007 | Schmitz et al. | |
| 7,251,917 | B2 | 8/2007 | Cvek | |
| 7,347,495 | B2 | 3/2008 | Beyer et al. | |
| 7,396,077 | B2 | 7/2008 | Boulva | |
| 7,419,222 | B2 | 9/2008 | Schmitz et al. | |
| 7,517,024 | B2 | 4/2009 | Cvek | |
| 7,530,640 | B2 | 5/2009 | Walters et al. | |
| 7,731,295 | B2 | 6/2010 | Lin | |
| 7,802,853 | B2 * | 9/2010 | Ebe | 297/452.27 |
| 7,806,478 | B1 | 10/2010 | Cvek | |
| 7,878,590 | B1 | 2/2011 | Bilak et al. | |
| 8,590,978 | B2 * | 11/2013 | Jaranson et al. | 297/452.15 |
| 8,602,494 | B2 | 12/2013 | Cvek | |
| 8,919,880 | B2 * | 12/2014 | Bellingar et al. | 297/284.1 |
| 8,973,990 | B2 * | 3/2015 | Krupiczewicz et al. | 297/218.1 |
| 2001/0043003 | A1 | 11/2001 | Knoblock et al. | |
| 2002/0117883 | A1 * | 8/2002 | Gevaert | 297/291 |
| 2005/0017565 | A1 * | 1/2005 | Sprouse | 297/452.41 |
| 2005/0052061 | A1 | 3/2005 | Deimen et al. | |
| 2005/0062323 | A1 | 3/2005 | Dicks | |
| 2005/0242652 | A1 | 11/2005 | Kepler et al. | |
| 2012/0061988 | A1 | 3/2012 | Jaranson et al. | |

* cited by examiner

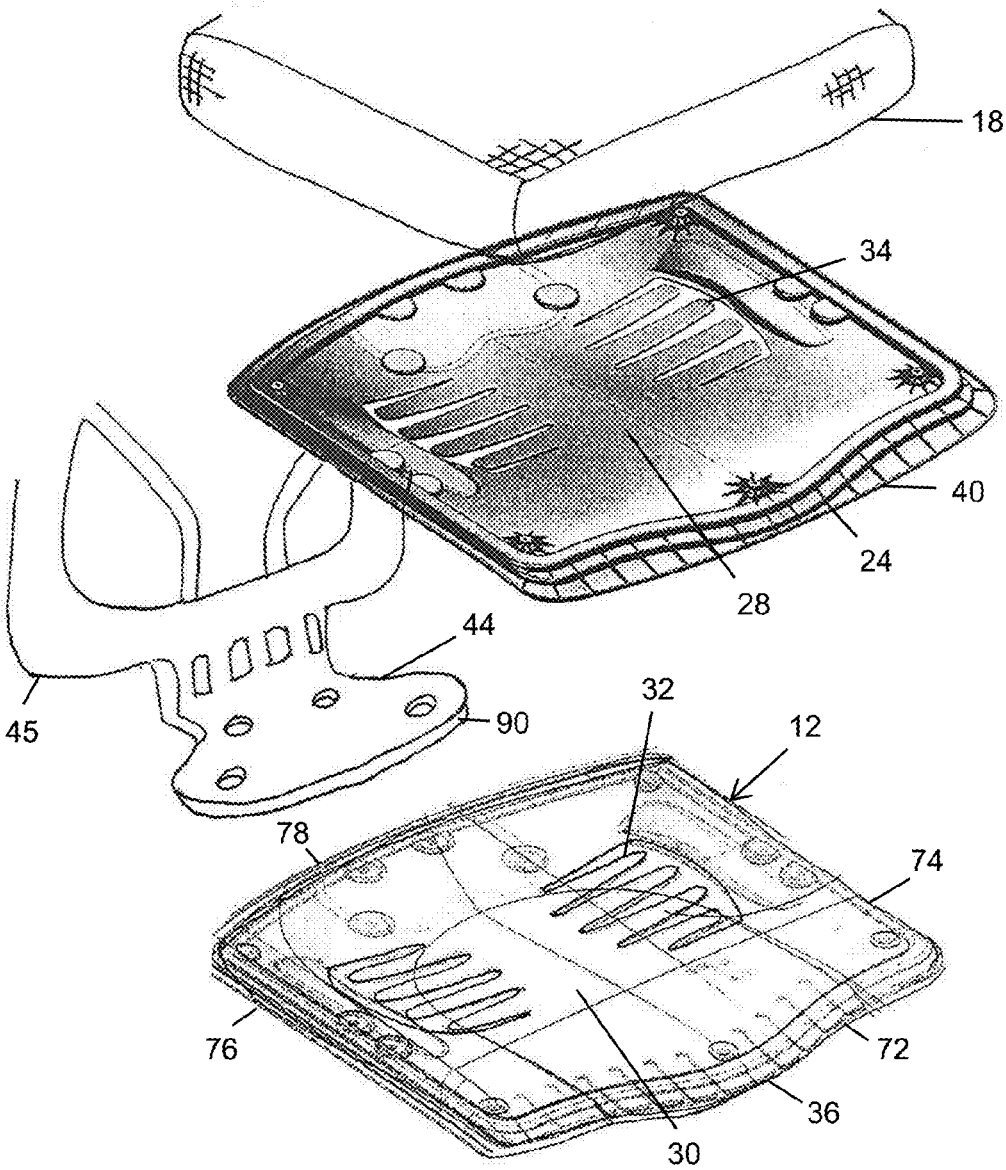
FIG. 2
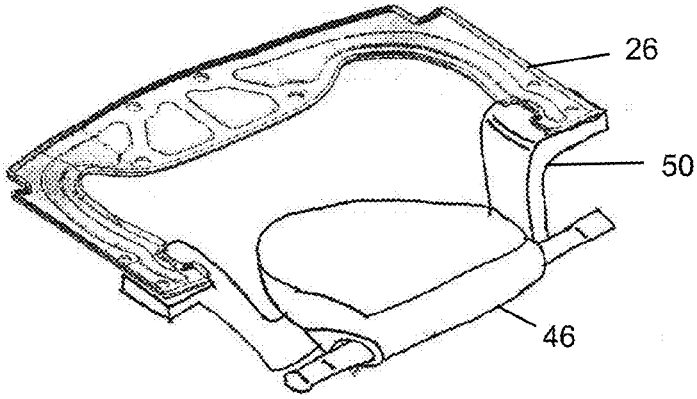

UPHOLSTERED SEAT WITH FLEXIBLE PELVIC SUPPORT

FIELD OF THE INVENTION

The present invention relates generally to seating. More particularly, disclosed herein are pelvic support and positioning devices for upholstered seats.

BACKGROUND OF THE INVENTION

Upholstered mobile task chairs and similar seating structures present a number of issues that must be confronted by the designer. A fundamental goal is, of course, to provide comfortable, ergonomically sound support to the seat occupant. While stable support is sought, it is also desirable to provide an upholstered seat bottom that permits enhanced flexibility and comfort in the support of the pelvis. The inventor has appreciated that still further advantage would be gained by providing resilient support in a seat bottom that can vary in a hyper-localized manner whereby the seat bottom can conform further and more accurately to a seat occupant's ergonomic needs. In upholstered seat design, a designer must further ensure that the seat pan underlying the upholstery and any underlying cushioning material permits breathability so that, for example, air trapped in the seat can escape when an occupant sits or changes position and air can enter the inner volume of the seat when the occupant leaves the seat.

It is further recognized that the prior art has taught largely that a seat back with lumbar support should move in relation to the seat bottom as a seat occupant reclines or leans forward. However, as disclosed herein, providing fixed angle pelvic support and positioning through a pelvic support and positioning member fixed in relation to the seat bottom is desirable in that doing so would maintain proper ergonomic positioning of a seat occupant's pelvis even during forward and rearward pivoting of the seat. Such fixed pelvic support and positioning has application not only to upholstered seats but also to seats with elastomeric material stretched over a framework as shown and described in the present inventor's co-pending application Ser. No. 14/133,502, filed Dec. 18, 2013, which is incorporated herein by reference.

SUMMARY OF THE INVENTION

In view of the needs summarized above, the present invention is founded on the basic object of providing ergonomically sound pelvic support for upholstered seating applications.

An underlying object of the invention is to provide upholstered mobile task chair and similar seating structures with venting to permit breathability of the seat bottom.

A further object of embodiments of the invention is to provide an upholstered seat bottom that permits enhanced flexibility and comfort in the support of the pelvis with hyper-localized control over the resilient support provided by the seat bottom thereby to conform further and more accurately to a seat occupant's ergonomic needs.

In certain embodiments, another object of the invention is to provide consistent pelvic support and positioning, including during movement of a seat occupant, to facilitate sound ergonomic positioning in upholstered mobile task chair and other seating applications.

These and further objects and advantages of the present invention will become obvious not only to one who reviews the present specification and drawings but also to those who have an opportunity to experience an embodiment of an upholstered seat employing the pelvic support disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In one embodiment, the upholstered seat with flexible pelvic support is founded on a seat bottom with a seat pan with a central area, an anterior portion, a posterior portion, and left and right portions. Upholstery is retained relative to the seat pan, such as by being secured to an upholstery pan that is fastened to the seat pan. At least one resiliently deflectable pelvic support structure is retained relative to the seat pan at least partially within the central area of the seat pan. So constructed, the resiliently deflectable pelvic support structure provides resilient support to the seat occupant.

In certain manifestations of the invention, the at least one resiliently deflectable pelvic support structure can take the form of at least one resiliently deflectable finger retained relative to the seat pan. It is further contemplated that plural resiliently deflectable fingers can be retained relative to the seat pan, such as by having plural resiliently deflectable fingers project to within a left portion of the central area of the seat pan and plural resiliently deflectable fingers project to within a right portion of the central area of the seat pan. In one such example, the seat pan can have a longitudinally disposed central support portion, and the resiliently deflectable fingers can project laterally outboard from the central support member. The resiliently deflectable fingers can have different deflection resistances, such as by having different lengths.

Embodiments of the seat can have a rigidifying member secured to the seat pan. The rigidifying member can be U-shaped with a rear leg fixed to the posterior portion of the seat pan, a left leg fixed to the left portion of the seat pan, and a right leg fixed to the right portion of the seat pan whereby rigidified lateral and posterior portions of the seat pan are established. In such embodiments, the posterior portion and at least the posterior segments of the left and right portions of the seat pan can be substantially rigid while the anterior portion of the seat pan is relatively flexible. The flexibility of the anterior portion of the seat pan can be facilitated by flexion relief formations spaced along the anterior portion of the seat pan.

A resiliently compressible foam structure can be retained on the seat pan. The resiliently compressible foam structure can have a U-shaped outer portion of relatively hard foam and an inner portion of relatively soft foam whereby the inner and outer portions cooperate to establish a cradle for a seated occupant.

Still further, an upholstery pan corresponding in shape to the seat pan can be secured to the seat pan with the upholstery secured to the upholstery pan. The upholstery pan can have resiliently deflectable pelvic support structures corresponding to the resiliently deflectable pelvic support structure retained relative to the seat pan.

The seat can be further refined by a seat back with a back frame, a panel of material retained spanning the back frame, and a support and positioning member retained in a fixed angular orientation relative to the seat bottom. The seat back can have a base plate disposed at a fixed angle in relation to the back frame, and the base plate can be fixed to the seat bottom. The back frame can have a flexible upper portion and a rigid lower portion. The fixed retention of the support and positioning member can be facilitated by can be facilitated by retaining the member by left and right rigidifying legs fixed to the back frame. The support and positioning member can be retained posterior to the panel of material of the seat back.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF DRAWINGS

In the accompanying drawing figures:

FIG. 2 is an alternative exploded perspective view of the upholstered seat with pelvic support according to the invention;

Figure 1:
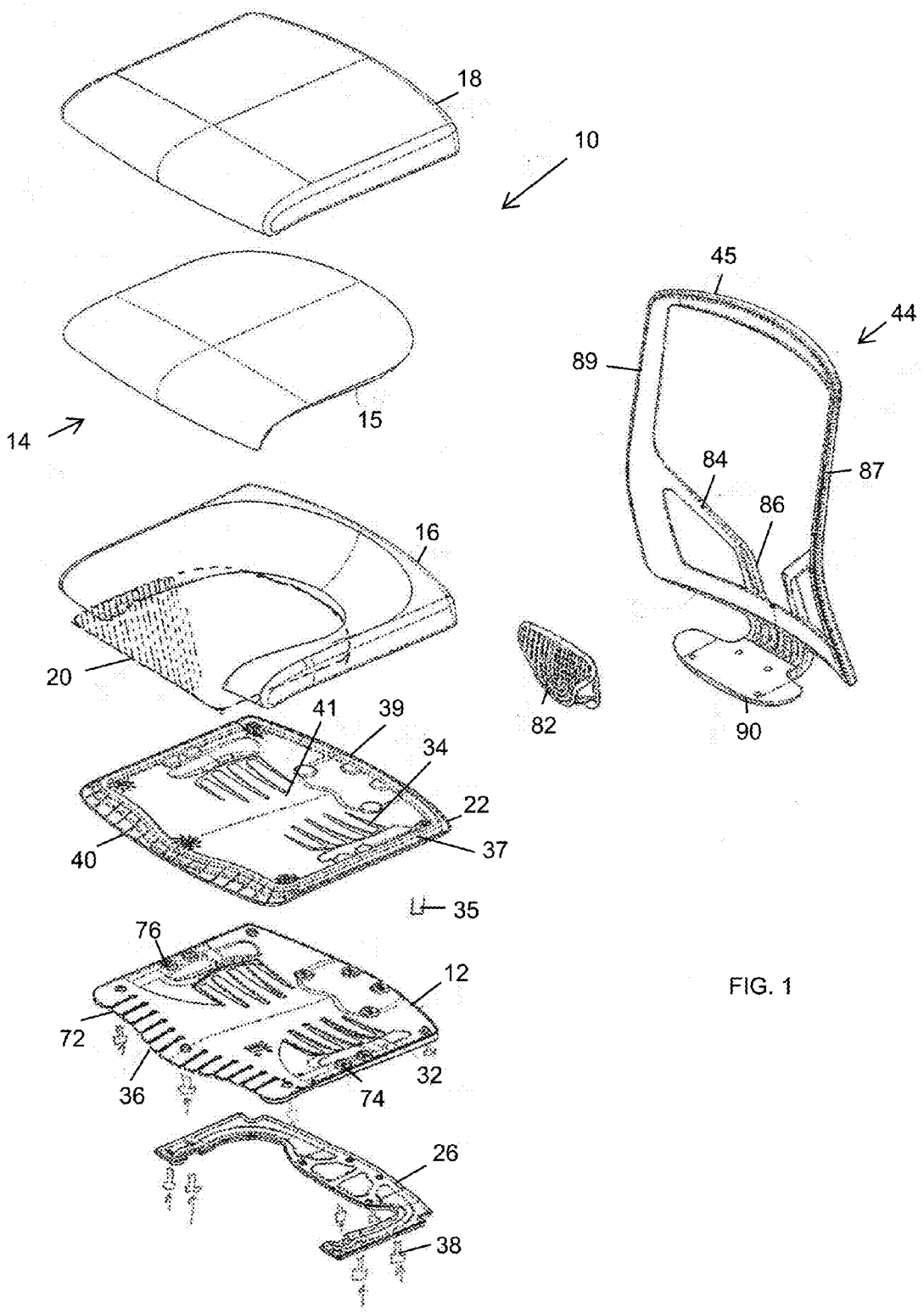
FIG. 1 is an exploded perspective view of an upholstered seat with pelvic support as disclosed herein.

Any notes and details that may be included in the drawings are incorporated herein by reference but should not be interpreted as limiting the scope of protection of the invention in any manner.

DISCLOSURE OF EXEMPLARY EMBODIMENTS

The upholstered seat with pelvic support disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

Turning more particularly to the drawings, an upholstered seat bottom with a pelvic support according to the invention is indicated generally at 10 in FIGS. 1 and 2, and a seat back with pelvic support and positioning is indicated generally at 44. The seat bottom 10 can be considered to be founded on a seat pan 12 of substantially rigid material, such as a substantially rigid plastic. The seat pan 12 has a plurality of flexible or otherwise resiliently deflectable fingers 32 that project laterally outboard to left and right portions of the seat pan 12 from a longitudinally disposed rigid central portion 30. The longitudinally disposed central portion 30 traverses from a mid-section of a forward portion 72 of the seat pan 12 to a mid-section of a rearward portion 78 of the seat pan 12. The resiliently deflectable fingers 32 project into open areas within the seat pan 12 so that a seat occupant will induce proportionate deflection of the fingers 32 by sitting, leaning, and moving atop the seat bottom 10. As illustrated, the central portion 30, the fingers 32, and the remainder of the seat pan 12 can be integrally formed, as by molding, but this need not necessarily be the case. The fingers 32 can be identical or variable in flexible support as described further below.

Although the depicted fingers 32 project laterally outboard from a central portion 30 of the seat pan 12 in this exemplary embodiment, it will be appreciated that the fingers 32 could be otherwise disposed to similar advantage and within the scope of the invention except as it might be expressly limited. By way of example, the fingers 32 could project inboard from the laterally outboard left and right portions 74 and 76 of the seat pan 12, or the fingers 32 could project forward or rearward from the rearward portion 78 or the forward portion 72 of the seat pan 12. Moreover, it would be possible to have some combination of the foregoing or some other retention of the resilient fingers 32. In any such event, the resilient fingers 32 will preferably be disposed with body portions thereof underlying the projected location of a pelvis 100 of a properly seated seat occupant as shown, for example, in FIGS. 7 through 9.

Figure 3:
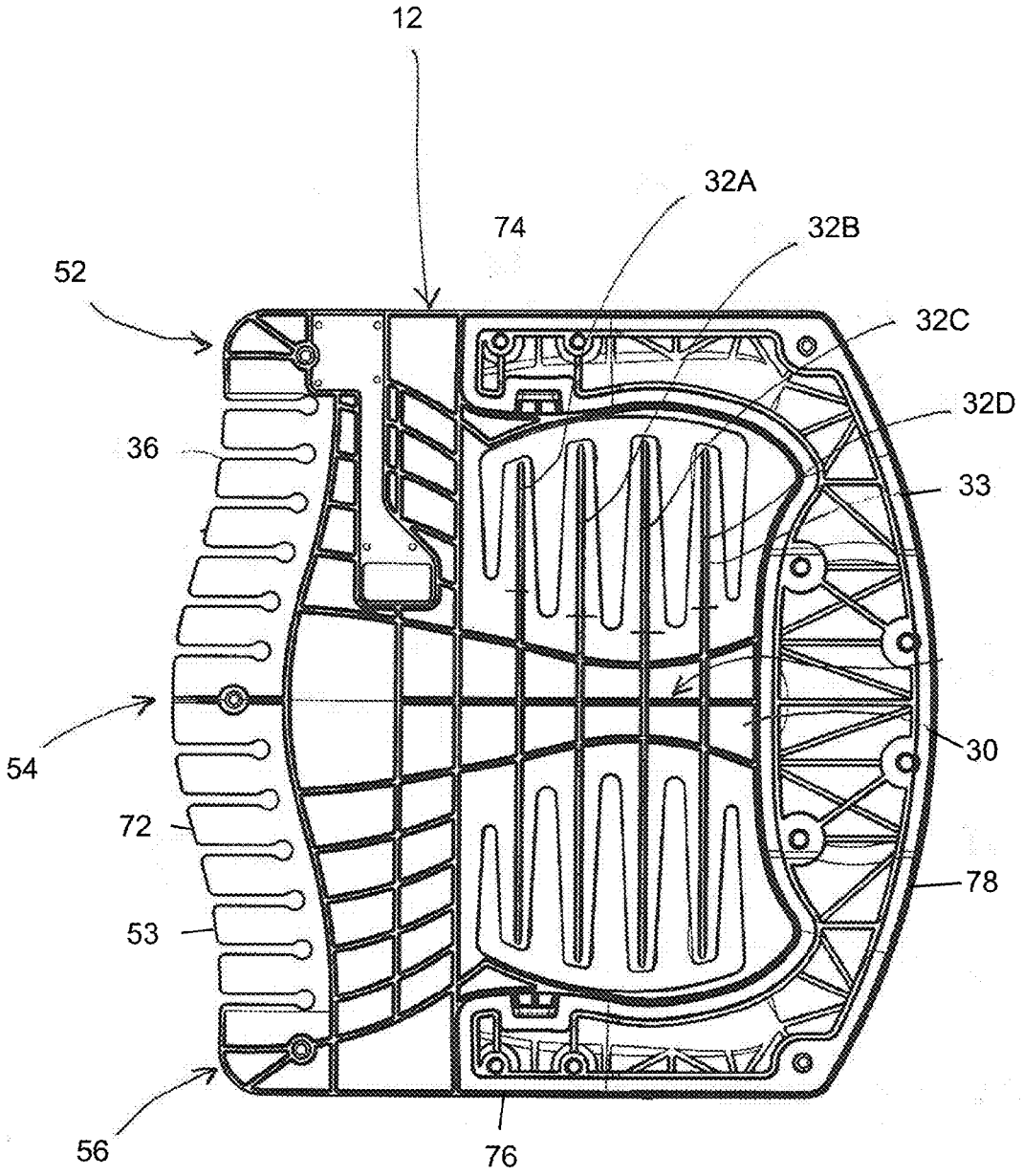
FIG. 3 is a bottom plan view of a seat pan for an upholstered seat with pelvic support as taught herein.

With additional reference to FIG. 3, the front portion 72 of the seat pan 12 has a plurality of flexion relief formations 36 disposed therein in longitudinal alignment with the seat bottom 10. In this example, the flexion relief formations 36 comprise keyhole shaped openings that extend entirely through the anterior edge of the seat pan 12 whereby the wavelike anterior edge of the front portion 72 is itself divided into a plurality of flexible fingers 53. The rear portion 78 and at least the posterior segments of the left and right portions 74 and 76 of the seat pan 12 are substantially rigid. Moreover, the front portion 72 of the seat pan 12 has a rigid left end zone 52, a rigid central zone 54, and a rigid left end zone 56 with the flexible fingers 53 interposed between the zones 52, 54, and 56. The rigid zones 52, 54, and 56 can be established by rigidifying ribs as shown, by a thicker material portion, or by some other rigidifying method or combination thereof. In a similar manner, the central portion 30, the rear portion 78, and at least the posterior segments of the left and right portions 74 and 76 of the seat pan 12 can be rigidified by ribs, thicker material portions, or by another method or combination thereof.

Overlying the seat pan 12 is a correspondingly shaped and configured upholstery pan 22. As noted above, the seat pan 12 can be manufactured from a relatively hard and rigid material, such as a thermoplastic polymer, preferably glass filled nylon. The upholstery pan 22 can be formed from a relatively soft material, potentially a softer polymer, such as polypropylene.

The upholstery pan 22 has a plurality of flexible or otherwise resiliently deflectable fingers 34 that are oriented and located in correspondence to the location and orientation of the fingers 32 of the seat pan 12. As such, the fingers 34 project laterally outboard to left and right portions of the upholstery pan 22 from a longitudinally disposed central portion 41. The resiliently deflectable fingers 34 project into open areas within the upholstery pan 22. The central portion 41, the fingers 34, and the remainder of the upholstery pan 22 can in certain embodiments be integrally formed, such as by molding. The front portion of the upholstery pan 22 has a plurality of flexion relief formations 40 disposed therein corresponding to the shape and alignment of the flexion relief formations 36 in the seat pan 12.

When the seat bottom 10 is assembled, the upholstery pan 22 is interposed between the seat pan 12 and a resiliently compressible foam structure 14, and upholstery 18 is applied over the foam structure 14 and over the edges of the upholstery pan 22 to be fastened thereto. The upholstery 18 can, in one example, comprise multi-stretch fabric. The upholstery pan 22 has an upholstery channel 37 that traverses the entire periphery thereof, and the upholstery 18 is retained in place by, for instance, staples 35, glue, or other fastening means or combinations thereof. In one contemplated embodiment, staples 35 are passed through the upholstery 18 and into the upholstery pan 22 within the upholstery channel 37, possibly with the supplementation of adhesive, spaced over the entire periphery of the channel 37. To facilitate the retention of the upholstery 18, the upholstery channel 37 can have teeth 39 formed therealong for gripping the fastened upholstery 18.

Under this construction, the resilient fingers 32 and 34 cooperate to provide resilient, contoured support to a seat occupant of the upholstered seat bottom 10. By virtue of the open spacing around the fingers 32 and 34 in the seat pan 12 and the upholstery pan 22, venting of the upholstered seat bottom 10 is provided to permit breathability of the seat bottom 10. Furthermore, since the plurality of fingers 32 can be crafted to exhibit individualized bending resistances, the upholstered seat bottom 10 permits enhanced flexibility and comfort in the support of the pelvis 100 with hyper-localized control over the resilient support provided by the seat bottom 10 thereby to conform further and more accurately to a seat occupant's ergonomic needs.

As seen, for example, in FIGS. 2, 3, 8, and 9, the fingers 34 of the softer upholstery pan 22 are longer and wider than the fingers 32 of the seat pan 12. With that, the fingers 32 are prevented from piercing the compressible foam structure 14. Further protection and stability are provided by a panel 20 of structural breathable fabric. The panel 20 of structural breathable fabric also protects the foam structure 14 from the moving fingers 32 and 34 while permitting fresh air to enter and exit the compressible foam structure 14 and promoting a cooling of the seat bottom 10. The panel 20 of structural breathable fabric can be retained in position by any suitable method, such as by being adhered to the lower surface of the compressible foam structure 14.

The seat bottom 10 establishes rigid lateral and posterior portions with relatively flexible central and anterior support portions. A plurality of aspects of the invention contribute in this regard. In one aspect, the rear portion 78 and at least the posterior segments of the left and right portions 74 and 76 of the seat pan 12 are substantially rigid while the front portion 72 is relatively flexible, which can be accomplished by the flexion relief formations 36 and, additionally or alternatively, by a difference in material thickness or material selection in relation to the left, right, and rear portions 74, 76, and 78.

The relative rigidity of the lateral and rear portions 74, 76, and 78 is further achieved by securing a rear and lateral rigidifying member 26 to the seat pan 12. The rigidifying member 26 can be formed from a metal, such as steel spring material. The rigidifying member 26 can overlap with the rear portion 78 of the seat pan 12 and posterior portions of the left and right portions 74 and 76 such that it has a rear leg and truncated left and right legs. The rigidifying member 26 is thus generally U-shaped thereby leaving open anterior and interior portions to permit the desired flexibility of the anterior and interior portions of the seat pan 12. The open anterior and central portions left by the rigidifying member 26 permit free motion of the flexible fingers 32 and the anterior portion 72 of the seat pan 12. In this depicted embodiment, the rigidifying member 26 can be formed with rigidifying shaping and contouring corresponding to the shape and contour of the overlapping portions of the peripheral framework 28. The rigidifying member 26 can be secured to the left, right, and rear portions 74, 76, and 78 of the seat pan 12 by mechanical fasteners 38 or in any other effective manner.

Figure 4:
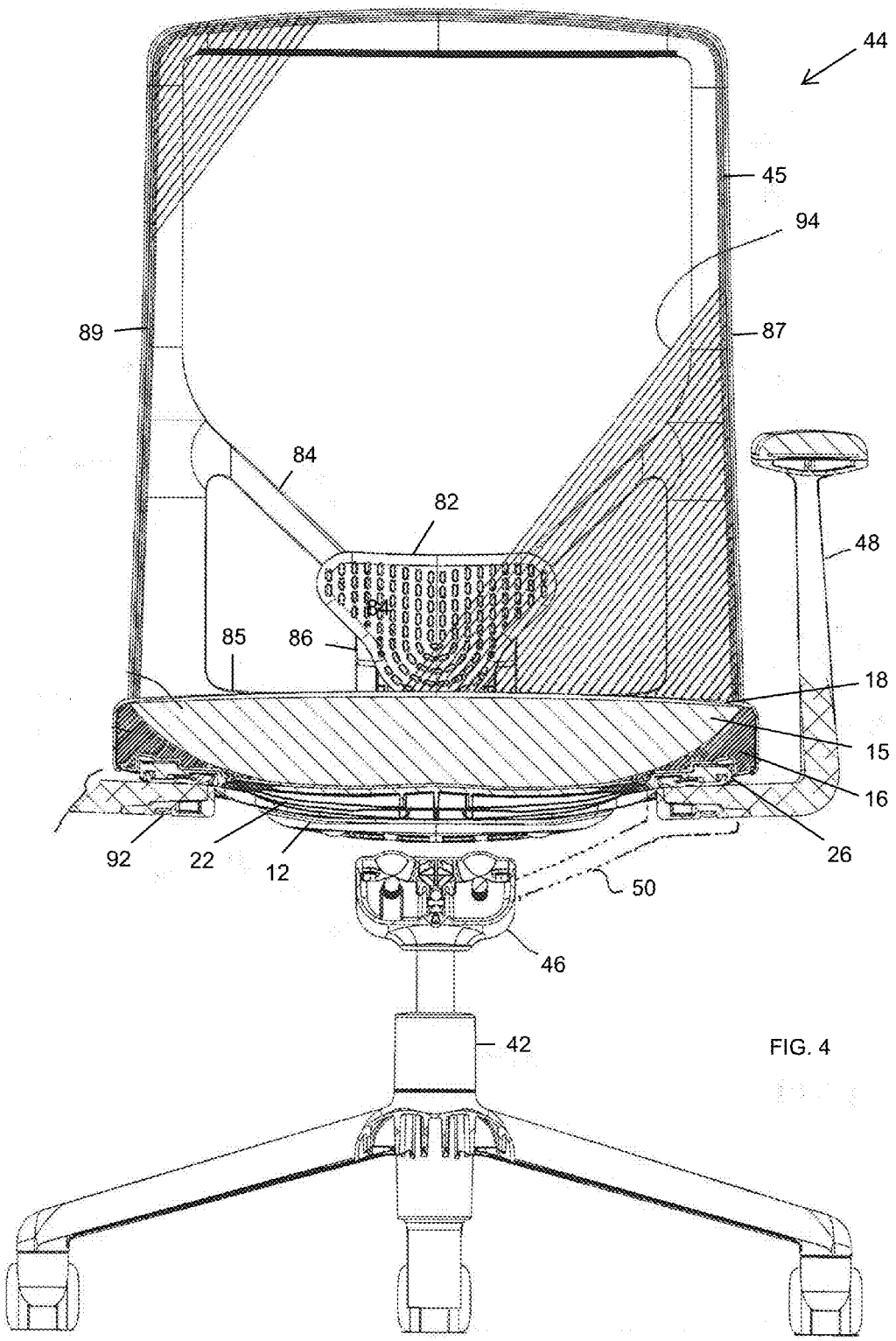
FIG. 4 is a cross-sectioned view in front elevation of the upholstered seat with pelvic support pursuant to the invention.
Figure 5:
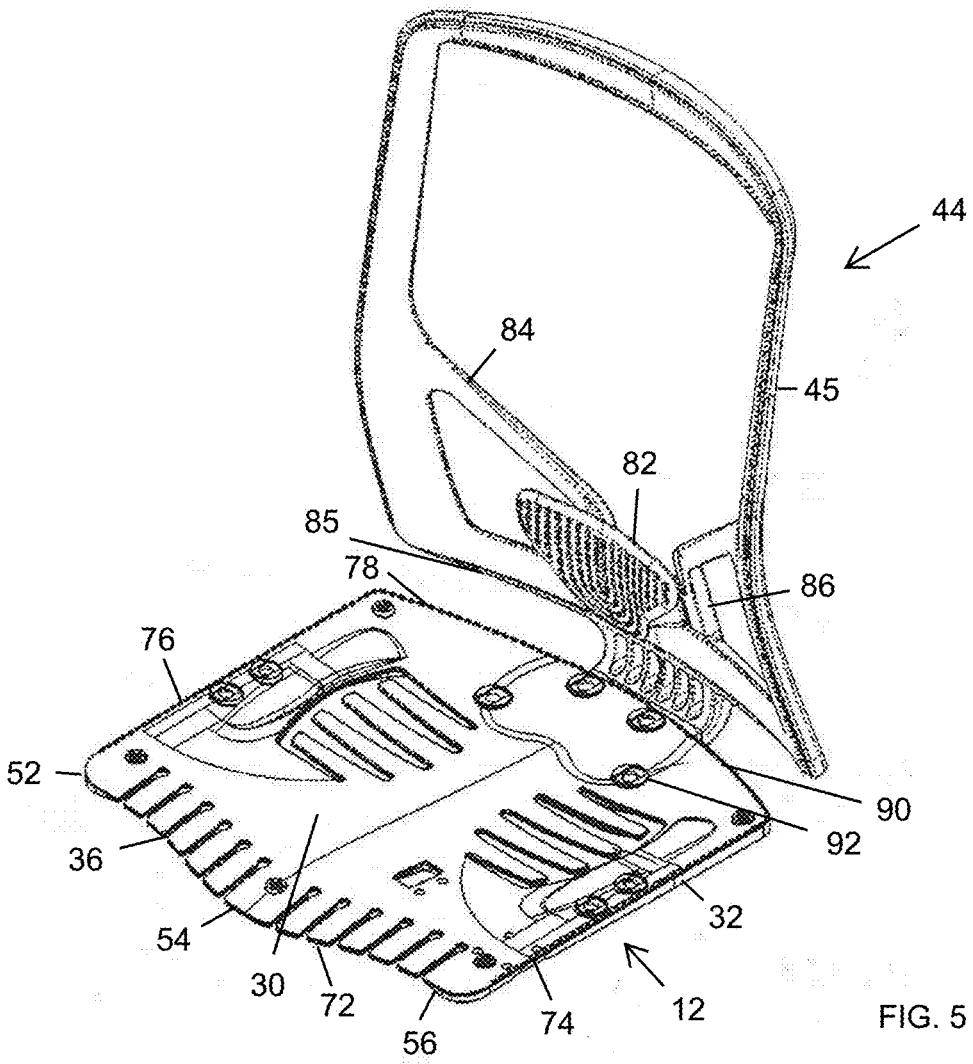
FIG. 5 is a perspective view of a seat back fastened to a seat pan for use in an upholstered seat with pelvic support.
Figure 6:
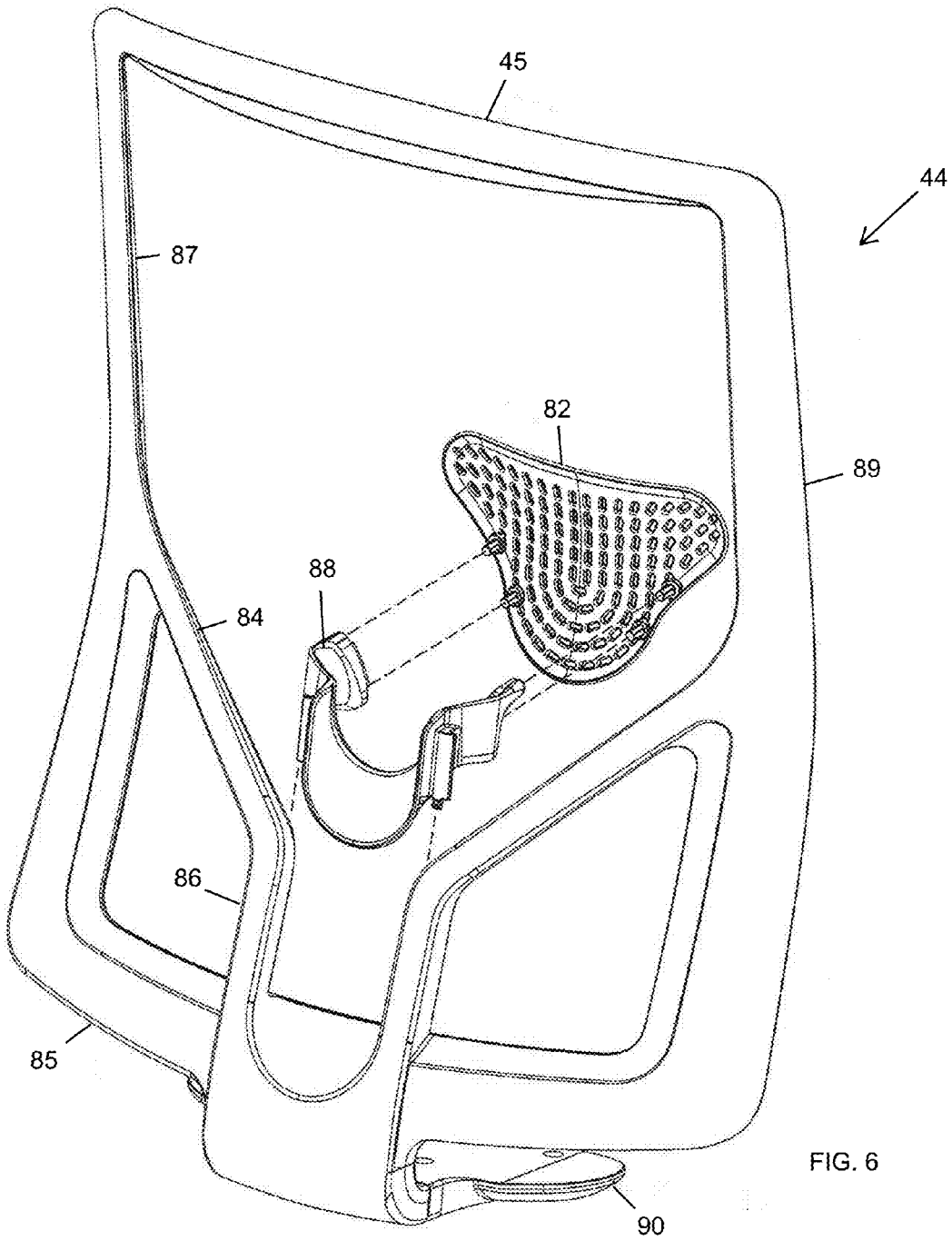
FIG. 6 is a rearward perspective view of a seat back with a pelvic support and positioning member as taught herein.

As is illustrated, for example, in FIGS. 2 and 4, the anterior ends of the left and right legs of the rigidifying member 26, which terminate at mid-portions of the left and right portions 74 and 76 of the seat pan 12, can be employed for coupling to a support mechanism 46, such as through support arms 50 of the seat support mechanism 46 and, through the support mechanism 46, a chair base 42. The chair back 44 can be retained by having a base plate 90 thereof fixed to the seat bottom 10 by being secured to the rigidifying member 26, and a panel 94 of elastomeric material can be disposed under an initial tension spanning the frame 45 of the chair back 44. Seat arms 48, which can be fixed or adjustable in height, optionally can be retained, such as by being fixed to the support mechanism 46, the rigidifying member 26, a combination thereof, or to some other chair component.

Still further control over the localized rigidity of the seat bottom 10 is achieved by use of the compressible foam structure 14 with localized, intra-layer variations in compression characteristics, such as through variations in density. The shapes and locations of the variations in compression characteristics can vary depending on, among other things, manufacturing goals, anticipated user preferences, and other characteristics. As best seen in FIG. 1, the compressible foam structure 14 in this example of the invention has a contoured, U-shaped outer portion 16 and a complementary inner portion 15 that is surrounded by the outer portion 16 but for the anterior portion thereof. The portions 15 and 16 have different compressibilities but are joined, such as by bonding, integral formation, interlocking, or in any other manner or combination thereof, in juxtaposition within a single layer or level. In one practice of the invention, the inner portion 15 can be softer and more easily compressed than the outer portion 16. The outer portion 16 thus establishes a posterior U-shape with a relatively rigid rear portion and relatively rigid left and right legs. With that, the inner and outer portions 15 and 16 cooperate to establish what is effectively a cradling of a seated occupant.

Within the scope of the invention, the portions 15 and 16 may overlap one another, whether by sloped, complementary faces, by a tongue-and-groove relationship, or by some other overlapping configuration. Also, while two distinct portions 15 and 16 are shown, it will be understood that more and differently configured portions may be exploited.

Figure 9:
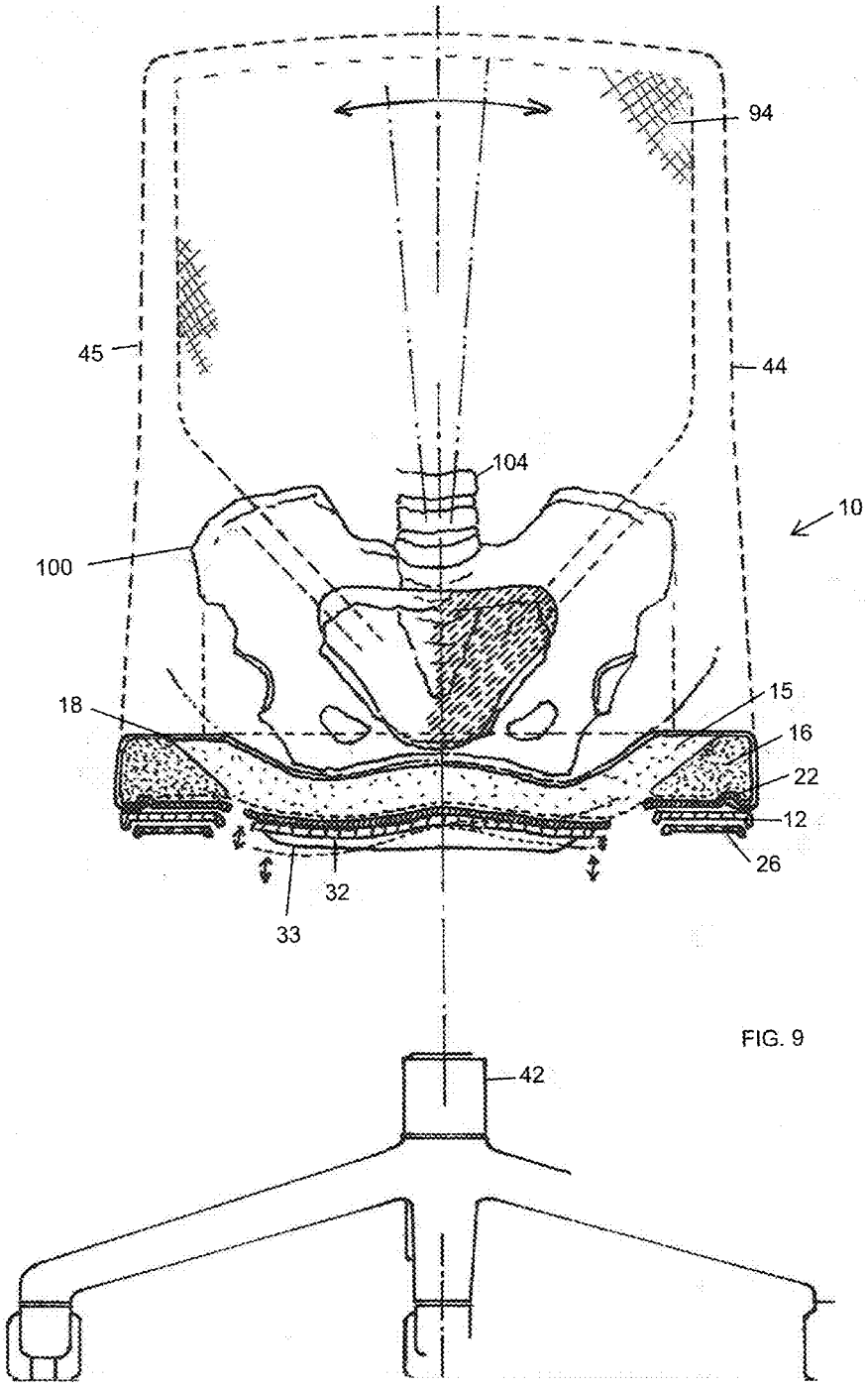
FIG. 9 is a partially sectioned view in rear elevation of an upholstered mobile chair with pelvic support pursuant to the invention.

As taught herein, hyper-localized variations in supportive force can be realized by variations in the shape, size, configuration, material, or other characteristic of the several fingers 32. For example, as FIG. 3 shows, fingers 32A, 32B, 32C, and 32D to each side of the central portion 30 can vary in length thereby to operate over different average moment arms and to exhibit different deflection resistances and load capacities. As seen in FIGS. 3 and 9, the fingers 32 can have longitudinal, potentially tapered, ridges 33 disposed along the lower faces thereof such that the fingers 32 pursue T-shaped cross sections. With that, deflection resistances of the fingers 32 can be further varied and controlled to provide localized control over the support provided to the seat occupant. The fingers 32 can also vary in width, length, and shape to apply supporting force over varied shapes and areas. As contemplated herein, therefore, differentiated flex zones can be created based on, among other things, expected load distributions on the seat bottom 10. Within the scope of the invention, therefore, fingers 32 or other resiliently deflectable members can be varied in resilience, number, shape, and location.

Further pelvic support and positioning can be provided by a support and positioning member 82 retained by the frame 45 of the seat back 44. Where the seat back 44 retains a panel 94 of elastomeric material as shown, for example, in FIGS. 4, 7, and 9, the support and positioning member 82 can be disposed posterior to the panel 94 of material. The support and positioning member 82, which can be multidirectionally flexible, is preferably maintained in a fixed angular orientation relative to the seat bottom 10. While the member 82 may itself be flexible for the comfort of the seat occupant, the fixed angular position of the support and positioning member 82 is achieved by a fixed, non-pivoting connection of the seat back 44 to the seat bottom 10 in conjunction with a substantial rigidity of the lower portion of the seat back 44.

The fixed connection of the seat back 44 to the seat bottom 10 could be accomplished in a number of ways within the scope of the invention. In the present embodiment, the seat back 44 has a base plate 90 disposed at a fixed angle in relation to the back frame 45, such as by being formed integrally therewith in a molding process. The base plate 90 and thus the seat back 44 in general are fixed to the seat bottom 10 by mechanical fasteners 92 passed through the base plate 90 and into the rigidifying member 26 as seen, for example, in FIG. 8. The back frame 45 has a flexible upper portion and a rigid lower portion.

Since the support and positioning member 82 is retained in a fixed position by the rigid lower portion of the seat back frame 45, a substantially fixed pelvic support angle $\alpha$ is established between a line of pelvic support PS established by the member 82 and a support surface S of the seat bottom 10. As taught herein, the angle $\alpha$ is substantially fixed.

The depicted embodiment achieves the fixed positioning of the member 82 relative to the remainder of the seat back 44 through left and right vertical members 86 that fixedly project from a rigid base leg 85 of the seat back 44 and lateral members 84 fixed to the upper ends of the vertical members 86 to be fixed to the left and right upright legs 87 and 89 of the frame 45. A rigid retention system is thus established with the vertical members 86 acting as receivers for a bracket 88 that in turn retains the support and positioning member 82. While this could be accomplished in multiple ways, the illustrated vertical members 86 have receiving channels therein while the bracket 88 has aligned, outboard ridges for being slidably received by the channels. When the seat bottom 10 and seat back 44 are fully assembled as, for example, in FIGS. 7 through 9, the support and positioning member 82 is retained in a fixed position relative to the seat bottom 10 posterior to the panel 94 of elastomeric material.

Figure 7:
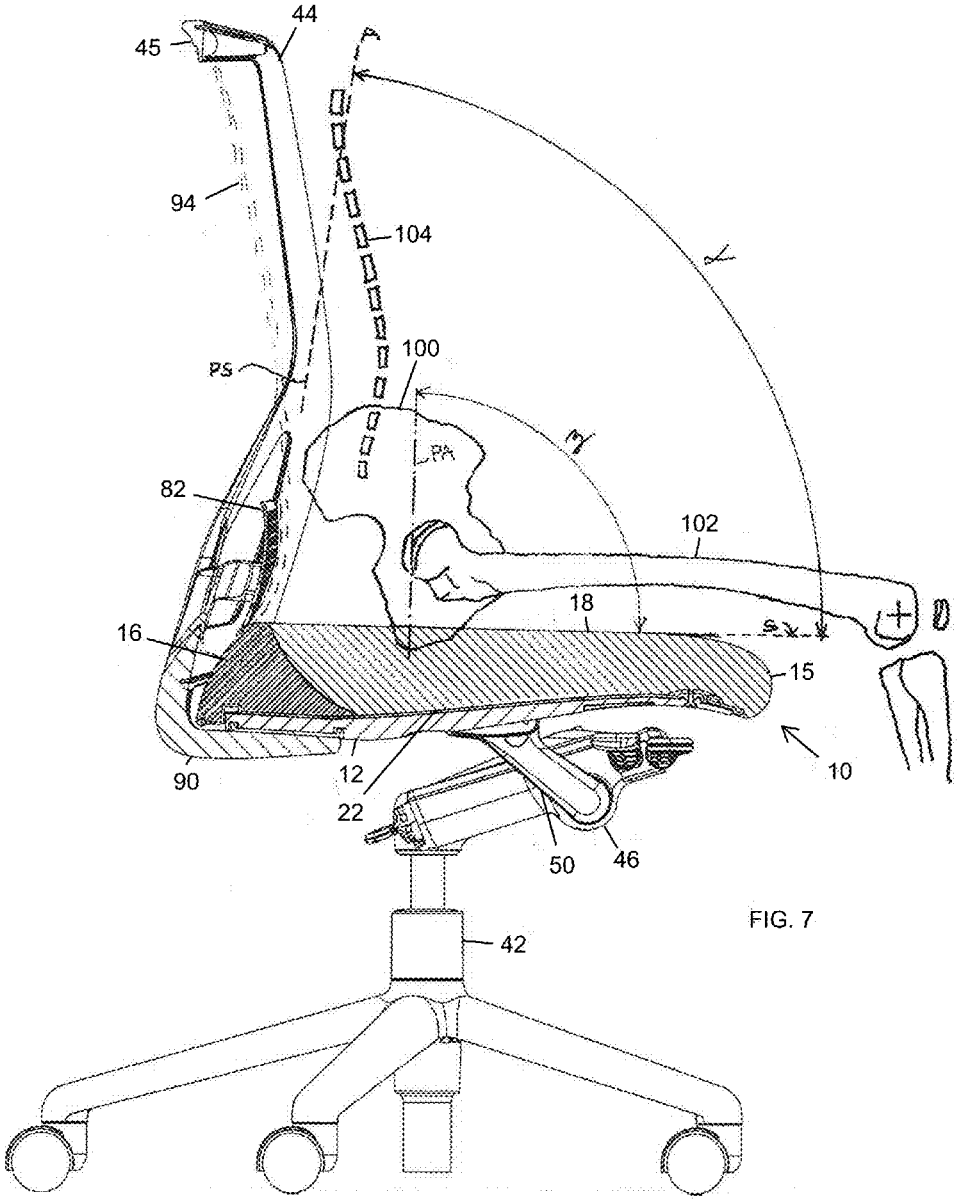
FIG. 7 is a partially sectioned view in side elevation of an upholstered mobile chair with pelvic support according to the invention.
Figure 8:
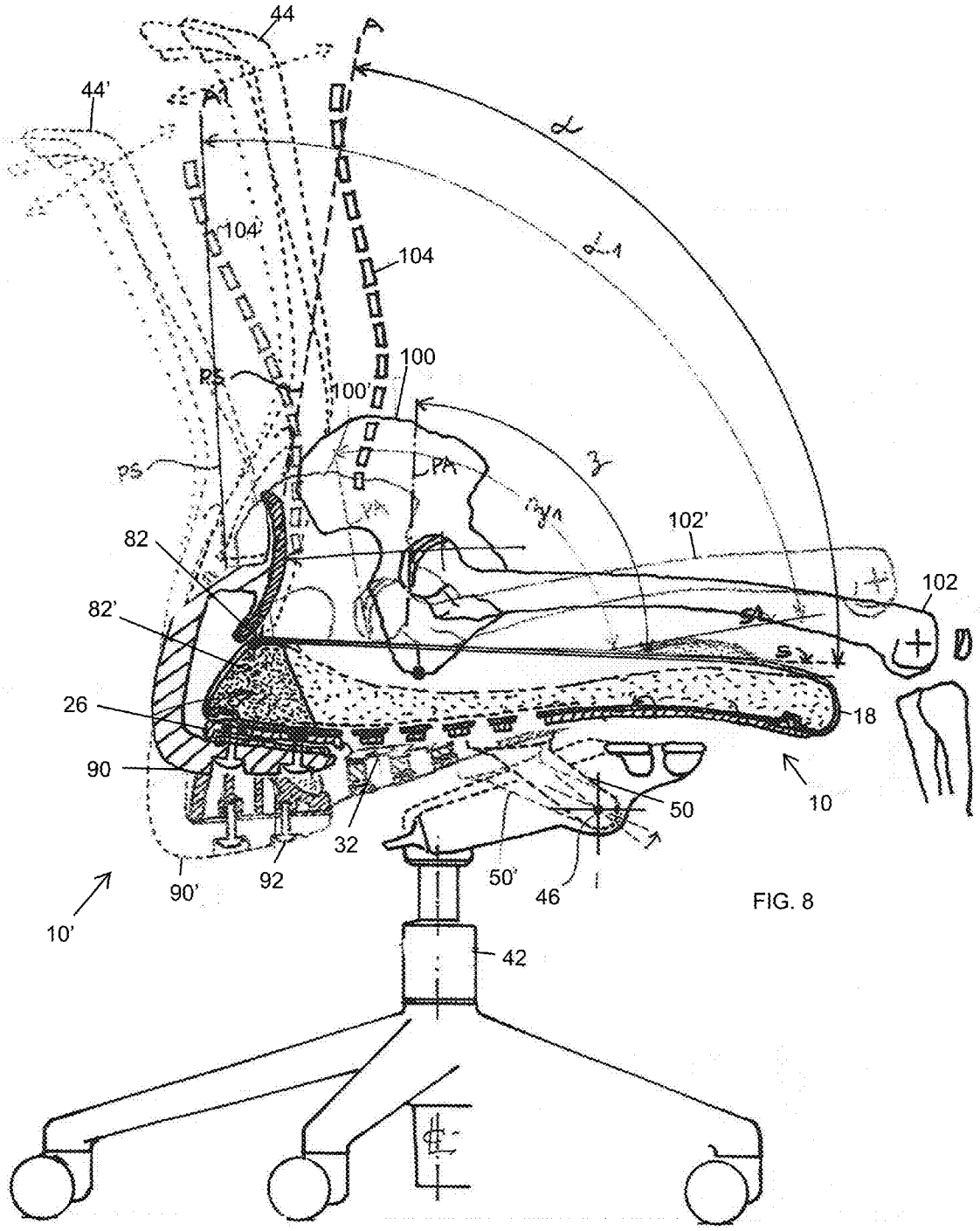
FIG. 8 is a further partially sectioned view in side elevation of an upholstered mobile chair with pelvic support.

With further reference to FIGS. 7 through 9, it will be seen that an angle $\beta$ is established when a seat occupant is seated with his or her pelvis 100 supported by the surface S established by the upholstery 18 and the pelvis 100 is supported and positioned by the support and positioning member 82. With the ergonomic positioning encouraged by the member 82 and its fixed positioning relative to the seat bottom 10, the person's pelvis 100 will be supported at a pelvic angle PA relative to the surface S to establish the angle $\beta$, and his or her spine 104 will assume a natural S-curve while the femurs 102 of his or her legs will rest comfortably on the relatively flexible central and anterior portions of the seat bottom 10.

When the support arms 50 are pivoted, such as to the position indicated at 50' and the seat bottom 10 moves to the position suggested by 10', the pelvis 100 will move to the position indicated at 100' and the femurs 102 to a position indicated at 102'. The support and positioning member 82 will move with the seat bottom 10 to the position indicated at 82'. The adjusted angle $\alpha 1$ will substantially match the original angle $\alpha$, and the differences between the angles $\alpha$ and $\alpha 1$ will substantially match or be in correspondence with the differences between the angle $\beta$ and the adjusted angle $\beta 1$ between the pelvic angle PA and the seat surface S.

Accordingly, with the fixed support and positioning member 82, proper ergonomic positioning of the pelvis 100 and spine 104 will be maintained. Moreover, while the position of the member 82 remains unchanged relative to the seat bottom 10 to provide a substantially constant pelvic support angle $\beta$, the flexibility of the central and anterior portions of the seat bottom 10 permits comfortable forward, rearward, and lateral tilting of the seat occupant. By the flexibility of the resilient fingers 32, the pelvis 100 and spine 104 of the seat occupant enjoy continued ergonomic support, including during a lateral tilting of the pelvis 100 and spine 104 as suggested in FIG. 9. As the pelvis 100 and spine 104 move, they continue to be cradled by the resiliently compressible foam 14 with localized, intra-layer variations in compression characteristics. By a selective variance of the resilient support provided by the fingers 32 as described previously, hyper-localized control can be exercised over the resilient support provided to the pelvis 100 and the seat occupant in general.

With certain details and embodiments of the present invention for upholstered seats with pelvic support disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. An upholstered seat with flexible pelvic support, the seat comprising: a seat bottom with a seat pan with a central area, an anterior portion, a posterior portion, and left and right portions; upholstery retained relative to the seat pan; a rigidifying member secured to the seat pan wherein the rigidifying member is U-shaped with a rear leg fixed to the posterior portion of the seat pan, a left leg fixed to the left portion of the seat pan, right leg fixed to the right portion of the seat pan and an open anterior portion whereby rigidified lateral and posterior portions of the seat pan are established; and plural resiliently deflectable fingers retained relative to the seat pan at least partially within the central area of the seat pan whereby the plural resiliently deflectable fingers provide resilient support to the seat occupant wherein at least one resiliently deflectable finger projects to within a left portion of the central area of the seat pan and at least one resiliently deflectable finger projects to within a right portion of the central area of the seat pan, wherein the seat pan has a substantially rigid, longitudinally disposed central support member, and wherein the resiliently deflectable fingers project laterally outboard from the central support member.

2. The upholstered seat with flexible pelvic support of claim 1 wherein the left and right portions of the seat pan have posterior segments, wherein the posterior portion and at least the posterior segments of the left and right portions of the seat pan are substantially rigid, and wherein the anterior portion of the seat pan is relatively flexible.

3. The upholstered seat with flexible pelvic support of claim 2 further comprising flexion relief formations spaced along the anterior portion of the seat pan.

4. The upholstered seat with flexible pelvic support of claim 1 further comprising a resiliently compressible foam structure retained by the seat bottom wherein the resiliently compressible foam structure has an outer portion of relatively hard foam and an inner portion of relatively soft foam whereby the inner and outer portions cooperate to establish a cradle for a seated occupant.

5. The upholstered seat with flexible pelvic support of claim 4 wherein the outer portion of the resiliently compressible foam structure is generally U-shaped.

6. An upholstered seat with flexible pelvic support, the seat comprising: a seat bottom with a seat pan with a central area, an anterior portion, a posterior portion, and left and right portions; upholstery retained relative to the seat pan; plural resiliently deflectable fingers retained relative to the seat pan at least partially within the central area of the seat pan wherein the plural resiliently deflectable fingers have locations and orientations whereby the plural resiliently deflectable fingers provide resilient support to the seat occupant; an upholstery pan corresponding in shape to the seat pan wherein the upholstery is secured to the upholstery pan and the upholstery pan is secured to the seat pan and wherein the upholstery pan has plural resiliently deflectable fingers corresponding in location and orientation to the locations and orientations of the plural resiliently deflectable fingers retained relative to the seat pan.

7. The upholstered seat with flexible pelvic support of claim 6 wherein the plural resiliently deflectable fingers have deflection resistances, wherein at least some of the plural resiliently deflectable fingers have different deflection resistances.

8. The upholstered seat with flexible pelvic support of claim 7 wherein at least some of the plural resiliently deflectable fingers have different lengths.

9. The upholstered seat with flexible support of claim 6 wherein at least one resiliently deflectable finger projects to within a left portion of the central area of the seat pan and at least one resiliently deflectable finger projects to within a right portion of the central area of the seat pan.

10. The upholstered seat with flexible pelvic support of claim 9 wherein plural resiliently deflectable fingers project to within the left portion of the central area of the seat pan and plural resiliently deflectable fingers project to within the right portion of the central area of the seat pan.

11. The upholstered seat with flexible pelvic support of claim 6 further comprising a seat back with a back frame and a panel of material retained spanning the back frame and further comprising a support and positioning member retained in a fixed angular orientation relative to the seat bottom.

12. The upholstered seat with flexible pelvic support of claim 11 wherein the seat back has a base plate disposed at a fixed angle in relation to the back frame and wherein the base plate is fixed to the seat bottom.

13. The upholstered seat with flexible pelvic support of claim 12 wherein the back frame has a flexible upper portion and a rigid lower portion.

14. The upholstered seat with flexible pelvic support of claim 13 wherein the support and positioning member is retained by the seat back wherein the back frame has peripheral upper, lower, left, and right legs that cooperate to define a central area, a left rigidifying leg with a first end fixed to the lower leg, a second end fixed to the left leg, and a portion between the first and second ends within the central area of the seat back, and a right rigidifying leg with a first end fixed to the lower leg, a second end fixed to the right leg, and a portion between the first and second ends within the central area of the seat back, and wherein the support and positioning member is retained by the left and right rigidifying legs within the central area of the seat back.

15. The upholstered seat with flexible pelvic support of claim 14 wherein the support and positioning member is retained posterior to the panel of material of the seat back.

* * * * *